US009290996B2

(12) United States Patent
Powell et al.

(10) Patent No.: US 9,290,996 B2
(45) Date of Patent: Mar. 22, 2016

(54) RADIAL VIBRATIONAL APPARATUS

(75) Inventors: Peter Evan Powell, Timaru (NZ); Roland Greenwood, Victoria (AU); Danny Sisson, Timaru (NZ)

(73) Assignee: FLEXIDRILL LIMITED, North Shore City (NZ)

( * ) Notice: Subject to any disclaimer, the term of this patent is extended or adjusted under 35 U.S.C. 154(b) by 582 days.

(21) Appl. No.: 13/807,977

(22) PCT Filed: Jun. 29, 2011

(86) PCT No.: PCT/NZ2011/000123

§ 371 (c)(1), (2), (4) Date: Mar. 21, 2013

(87) PCT Pub. No.: WO2012/002827

PCT Pub. Date: Jan. 5, 2012

(65) Prior Publication Data

US 2013/0168080 A1 Jul. 4, 2013

(30) Foreign Application Priority Data

| | | |
|---|---|---|
| Jul. 1, 2010 | (NZ) | 586560 |
| Jul. 19, 2010 | (NZ) | 586882 |
| May 24, 2011 | (NZ) | 593040 |

(51) Int. Cl.

| | |
|---|---|
| ***E21B 6/00*** | (2006.01) |
| ***E21B 7/24*** | (2006.01) |
| ***E21B 4/02*** | (2006.01) |
| ***E21B 31/00*** | (2006.01) |

(52) U.S. Cl.

CPC ... *E21B 7/24* (2013.01); *E21B 4/02* (2013.01); *E21B 6/00* (2013.01); *E21B 31/005* (2013.01)

(58) Field of Classification Search

CPC ..... E21B 6/00; E21B 31/005; E21B 7/24; E21B 4/02

See application file for complete search history.

(56) References Cited

U.S. PATENT DOCUMENTS

| | | | | |
|---|---|---|---|---|
| 2005/0194187 | A1* | 9/2005 | Gleitman et al. | 175/57 |
| 2010/0212967 | A1* | 8/2010 | Powell et al. | 175/106 |

FOREIGN PATENT DOCUMENTS

| | | |
|---|---|---|
| WO | 2006/065155 | 6/2006 |
| WO | 2008/121004 | 10/2008 |
| WO | 2009/028964 | 3/2009 |
| WO | 2011/136663 | 11/2011 |

* cited by examiner

*Primary Examiner* — Brad Harcourt
(74) *Attorney, Agent, or Firm* — Jacobson Holman, PLLC.

(57) ABSTRACT

A downhole assembly able to generate a vibrational output reliant upon a fluid feed drive to cause relative rotation extending magnetic arrays and thereby a relative longitudinal vibration causing reciprocation.

15 Claims, 13 Drawing Sheets

RADIAL VIBRATIONAL APPARATUS

Figure 1A:
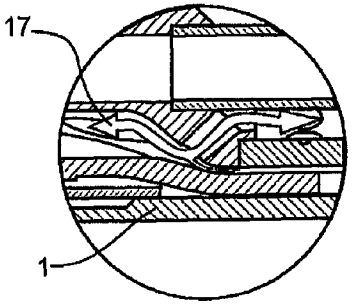

This is a national stage of PCT/NZ11/000123 filed Jun. 29, 2011 and published in English, which has a priority of New Zealand no. 586560 filed Jul. 1, 2010, New Zealand no. 586882 filed Jul. 19, 2010, and New Zealand no. 593040 filed May 24, 2011, hereby incorporated by reference.

The present invention relates to a vibrational and/or hammering apparatus suitable for use downhole in a drill string.

Examples of use for such apparatus include, but are not limited to, apparatus for use downhole eg. as hammers, as shakers, continuous tubing drilling, freeing drill strings that are stuck, etc. Use downhole can be anywhere in the string.

The present invention recognises an advantage to be derived for drilling in having a vibrational—or hammering action positioned as part of the drill string (anywhere in the drill string—top end, middle, bottom end, etc—including combinations) and to have part thereof synchronised to the drill string.

The present invention envisages the positioning of two magnetic arrays in any number of configurations, using a wide variety of magnet shapes, to provide the desired effect whereby, under the rotational input of the first array, the second array is caused to reciprocate axially within the (generally tubular) tool housing.

In shallow bore holes, where there is very low bore hole pressure, it can be advantageous to have the axially moving array contained within an atmospheric chamber. In very deep bore holes, where the bore hole pressure is significant (in fact this may be many thousands of PSI) the use of conventional dynamic seals used to prevent the ingress of drilling fluid (which contains sand, rock particles, etc) into the tool and the consequent stalling of the axially moving array is a significant challenge.

In our PCT/NZ2005/000329 (published as WO2006/065155) we disclose the use of a shuttle carrying, at each end, magnetic arrays, each to interact out of phase with a dedicated complementary magnetic array as the shuttle is rotated, thereby causing the vibration to be generated axially relative to the shuttling of the shuttle with respect to the complementary arrays.

In our PCT/NZ2008/000217 (published as WO2009/028964) we disclose the use of such endwise interactions of magnetic arrays in hammering apparatus of a great variety of types.

The full content of the aforementioned specifications are hereby included by way of reference.

The present invention has as one of several, or several alternative objects, the provision of an assembly capable of providing a shuttling outcome responsive to a relative rotational drive reliant upon interactions of magnets arrayed about or substantially peripherally as part of a shafted assembly, ie. as if a rotor, with surrounding magnets arrayed (eg. as part of a surround structure), ie. as if a stator.

The present invention envisages mixed pole magnetic arrays each to interact with the other as inwardly directed and outwardly directed arrays of at least substantially concentric more outward and more inward assemblies respectively able to be mutually rotated (eg. as if a stator and a rotor) in a manner where movements substantially as hereinafter described can be achieved.

It is a further or alternative object to provide apparatus of that kind where there can be liquid content or liquid intrusion into some or at least some of the space between the magnetic arrays of inwardly directed and outwardly directed arrays of at least substantially concentric more outward and more inward assemblies respectively able to be mutually rotated (e.g. one which can be considered the stator and the other can be considered the rotor, or vice versa).

It is a further or alternative object to provide an assembly having a tube of a magnetic field permeable material (eg. inconel, titanium) about axial extending arrays of magnets about a rotor intended to co-act with a field of encircling magnets outside of the tube and not rotating with the rotor (ie. of a stator).

It is a further or alternative object to rely on axial dislocation, caused by relative rotation of inwardly directed and outwardly directed arrays of at least substantially concentric more outward and more inward assemblies respectively able to be mutually rotated, to generate a vibrational output.

It is a further or, alternative object to rely on axial dislocation, caused by relative rotation of inwardly directed and outwardly directed arrays of at least substantially concentric more outward and more inward assemblies respectively able to be mutually rotated, to generate a vibrational output despite a liquid being interposed between the arrays.

It is a further or alternative object to rely on axial dislocation, caused by relative rotation of inwardly directed and outwardly directed arrays of at least substantially concentric more outward and more inward assemblies respectively able to be mutually rotated, to generate a vibrational output despite a material of high electrical resistivity (e.g. inconel, titanium, plastics, carbon fibre composite, or the like) being interposed or being interposed as a cover or support of one or other or both arrays.

The present invention has as a further or alternative object the provision of apparatus able to provide a vibrational output which can achieve the outputs with fewer parts than those disclosed in the aforementioned patent specifications.

It is a further or alternative object to provide two interacting magnetic arrays of a drive receiving and a vibrational output device where inwardly directed and outwardly directed arrays of at least substantially concentric more outward and more inward assemblies respectively are able to be mutually rotated.

It is a further or alternative object to provide two interacting magnetic arrays of a drive receiving and a vibrational output device where inwardly directed and outwardly directed arrays of at least substantially concentric more outward and more inward assemblies respectively able to mutually rotate the polarity of one or both arrays alternates (or otherwise staggers or varies) both circumferentially and parallel to their relative rotational axis.

It is a further or alternative object of the present invention to provide at least partially fluid filled vibrational apparatus able to operate downhole or elsewhere with a reduced pressure differential between the ambient use environment and at least some zone(s) internally of the apparatus. Such a reduced differential, for example of a downhole hammer, obviates the need for high pressure sealing of a moving surface.

It is a further or alternative object of the present invention to provide a vibrational apparatus able to be operated downhole or elsewhere which has a facility whereby it can be readily tuned for frequency in a variety of different ways.

It is a further and alternative object of the present invention to provide a vibrational apparatus or hammering apparatus or shaker apparatus that can operate effectively with reduced manufacturing tolerances.

It is a further or alternative object of the present invention to provide vibrational apparatus or hammering apparatus or shaker apparatus having a stator and rotor able to be caused to move reciprocally one with respect to the other, the drive in at least one direction being as a result of at least substantially concentric interacting magnetic arrays carried by each outwardly of the common longitudinal axis [which is the rotational axis of the rotor relative to the stator (or vice versa)]. Such an object is preferably also to allow provision for tuning of the vibrational output by one or more means, such as, by way of example only, a choice of a member to provide for a strike at the end of one stroke or to provide a boundary for a fluid squeeze at the end of one stroke.

It is a further or alternative object of the present invention to provide vibrational apparatus able to be operated downhole where there is a flowpath through a magnetic array carrying rotor for a fluid that can pass to a more downhole zone (e.g. out of or to a downhole tool). It is another object optionally to have such fluid after having powered a PDM which rotates the rotor relative to a stator [which carries an array of interacting magnets] to cause shuttling as a consequence of the relative rotation, feed further downhole.

It is a further or alternative object to provide a separate flow through liquid or fluid (e.g. drilling mud) and to have a captive liquid (e.g. an oil) in a vibrational apparatus to resist (eg. downhole) external pressure.

It is a further or alternative object of the present invention to provide a vibrational apparatus where a stator (with a magnetic array) is the "shuttle" relative to both (1) a housing, a bit housing, a tool, a tool housing, or the like and (2) a rotor (with a magnetic array), and it is the action of the stator directly or indirectly on at least one impact zone of the housing, bit housing, tool, tool housing or the like that generates the vibration. For example the apparatus can be a downhole shaker or part of a continuous tubing drilling system.

It is a further or alternative object to rely on a rotor carried magnetic array to stator carried magnetic array interactions, over an annular interaction zone of axial extent of the overlap of the proximate interacting arrays, to move the stator relative to the rotor in axial directions.

It is still a further or alternative object to use such interactions as herein described and/or to provide internal and/or external arrays, rotors, stators and/or ancillary apparatus as herein described.

In many downhole tools used in high bore hole pressure environments, any atmospheric chamber is where possible avoided for the pressure differential sealing challenges outlined above.

However other such tools with dynamic (moving components) are either;

1. Subjected to full bore hole pressure by the drilling fluid (mud) and are designed to survive in this viscous—abrasive environment (eg. mud lubricated bearings—or mud driven fluid hammers)

2. Or use a clean fluid such as water (or similar) confined in a cavity.

It is a further or alternative object to have both a fluid filled cavity, with dynamically moving components—in a clean and sealed environment.

It is a further or alternative object to minimise fluid drag across the body of the moving components (axially oscillating magnetic array). To address this object it is desirable to;

1) have the magnetic array designed and assembled in a streamlined manner (eg. radial alignment)

2) have porting provided to allow the axially oscillating magnetic array to move through the fluid column with minimal drag.

We believe that without such features it is likely that the resistance would dramatically reduce the performance of the tool—or at worst hydraulically stall the axially oscillating magnetic array.

It is a further or alternative object to provide (one or several) pressure compensating pistons.

In practise, while every effort is made to fill the magnetic array cavity 100% with clean fluid (with no air entrapped within the tool), to an extent this is an impossible task and pressure compensating pistons within the tool housing can address any inadequacy in the fill.

In practise any air that is entrained within the tool will be subjected to the borehole pressure. As the air bubbles (essentially) collapse under the bore hole pressure, the compensating piston will force clean fluid into the cavities replacing the depleted air volume with the clean fluid.

We therefore propose that a low viscosity (substantially) non compressible fluid is used to fill the internal cavities of the tool, the result being that while the said fluid will decrease the performance of the tool to some extent, it will all but eliminate the high pressure differential sealing challenges, and require only conventional "wiper" type seals to prevent the drilling fluid from entering the tool.

In other less desirable methods of dealing with this issue are too;

pre charge the atmospheric chamber at surface with a pressurised gas to partially (or totally) match the anticipated bore hole pressure.

or utilise a slaved magnet drive as described in our PCT/NZ2011/000057.

It is a further or alternative object to address the stop/start reaction hereinafter described.

A development of a tool to this objective focuses on the input drive—between the PDM (or other rotational input—such as a mechanical connection from the surface) and the magnetic hammer. One of the unique characteristics of the magnetic hammer is that it generates a cogging reaction within the drive mechanism—that is—there is a magnetically induced torque reaction when the rotationally activated magnetic array is turned "away" from the rotationally constrained magnetic array. At this point the torque requirement can be significant. However after a few degrees of rotational movement, the rotationally driven array then accelerates towards the next (opposite pole) on the rotationally constrained array.

This action generates a stop/start type reaction in the input drive (PDM—Mechanical connection etc) which can be unhelpful for the following reasons;

1. It momentarily stalls the rotary input, thereby negatively affecting the impact action—thereby not allowing the hammer to advance through the formation to its maximum potential
2. It may cause fatigue damage to the input drive.
3. It may cause an unwanted torsional resonance within the drive mechanism (more likely if driven mechanically from the surface).

We therefore propose that either,

1. A longitudinal mechanical flywheel would be housed between the input drive (PDM etc) and the magnetic hammer, or a
2. magnetic flywheel housed between the input drive (PDM etc) and the magnetic hammer.

Either device would preferably (but not necessarily) be used in conjunction with the magnetic hammer. Either device would preferably be housed within a cylindrical housing.

The mechanical flywheel, would preferably incorporate a rotating mass within said body, preferably with an uninterrupted fluid path (for drilling mud etc) (preferably) through the flywheel, to allow uninterrupted flow to the hammer and bit.

The magnetic flywheel could have a rotating longitudinal member with magnets attached (embedded) with alternating poles, these magnets when rotated react with either;

fixed magnetic arrays (which cannot move either axially—or rotationally, except when in conjunction with the outer housing)—these arrays are 180 degrees out of phase with the magnetic arrays within the magnetic hammer or, react against metallic ribs within the surrounding body—these ribs would provide some magnetic attraction while the cut-outs in between would not.

Either type of mechanism would serve to smooth out the cogging effect that the magnetic hammer generates and lessen any negative effects.

Another advantage of this tool is that the drilling fluid delivery mechanism is of a uniform and non constraining nature—which limits the pressure drop through the tool. This is important to maximise the hydraulic fluid power available to the drill bit or other down hole tool for hole cleaning etc.

In an aspect the invention is a vibrational apparatus of a downhole assembly, or suitable for a downhole assembly, capable, in use, of providing a vibrational output downhole, the apparatus comprising or including first and second assemblies able to be caused to have a relative rotation about a rotational axis ("common axis") and as a consequence to assume a vibration causing reciprocating rectilinear movement along or parallel to the common axis able to be outputted;

wherein said first and second assemblies each has magnetic arrays set out from the common axis yet around the common axis and longitudinally of the common axis;

and wherein it is the interactions between the magnetic arrays across the longitudinally extending annular space between them, consequential to the relative rotation that provides a relative drive longitudinally of the common axis.

Preferably a fluid feed to the vibrational apparatus is able to cause the relative rotation.

Preferably said fluid feed is able to pass through the vibrational apparatus.

Preferably there is or can be a fluid feed to a PDM, turbine or the equivalent to rotate the innermost of the first and second assemblies is able to pass through the innermost of the first and second assemblies, the outermost of the assemblies being splined to, or otherwise non-rotatable relative to, an outer case of a drillstring of which vibrational apparatus is part as such as to cause the relative rotation about the common axis.

Optionally said first and second assemblies are enclosed in a common chamber.

Preferably said common chamber includes a liquid.

Optionally there is provided a magnetic drag drive to one or other of the assemblies, that particular assembly being in an enclosure which also includes the other assembly.

Optionally said first and second assemblies are each in a separate closed chamber and at least one and preferably both of said chambers includes a liquid.

Preferably there is a flywheel including rotational drive input to one of the first and second assemblies.

Optionally the flywheel is a mechanical or magnetic flywheel, a magnetic flywheel in the sense that it smoothes the cogging effect that otherwise might occur.

Optionally the flywheel is between a PDM and one of the first and second assemblies.

Preferably in the apparatus a liquid interposed between the assemblies assists, or will assist, in resisting ambient downhole pressure.

Optionally the vibrational apparatus is a hammering apparatus.

In another aspect the invention is a vibrational and/or hammering apparatus of or suitable for use downhole [eg. as part of a drill string, etc as previously mentioned], said apparatus comprising or including an elongate casing assembly aligned to the downhole axis, optionally a tool at the end of the casing assembly, a first magnetic array carried to rotate when the casing assembly is rotated, a second magnetic array carried to rotate relative to the first magnetic array so as to provide relative axial reciprocal movement as a consequence of the magnetic arrays interacting, optionally the relative movement to provide impacts at an impact zone internally of the casing assembly, optionally an energy recovery spring to assist movement reversal, a drive from a pdm or other input, the drive optionally having one or both (i) a fly wheel feature and/or (ii) magnets to act on other magnets or at least ferromagnetic materials to smooth out any substantial cogging affect.

In an or another aspect the invention is vibrational apparatus reliant upon relative rotation between supports for interacting at least substantially concentric magnetic arrays to cause a relative rectilinear movement able to be outputted as a vibrational output (eg. a hammering or shaking output); there being a drive to cause such relative rotation and apparatus (e.g. it may be the apparatus itself) to receive the kinetic energy of at least some of the rectilinear movement and thus the vibrational output.

Optionally one or more of the following applies the environment of the magnetic arrays is a fluid environment the fluid environment is ported to reduce drag "wiper" type seals seal between said fluid environment and ambient drill environment fluid the drive is enhanced to include flywheel characteristics the drive can be a slaved magnetic drive to allow input from one magnetic system to that slaved thereto, but in a different sealed environment, that slaved magnetic system to provide a mechanical rotation of one of the magnetic arrays relative to the other.

out of phase magnetic interactions to those of said magnetic arrays provide [whether magnet to magnet or magnet to ferromagnetic material] a smoothing out of the cogging effect.

In an or another aspect the invention is vibrational apparatus reliant upon relative rotation between supports for interacting at least substantially concentric magnetic arrays, one array of each support, to cause a relative rectilinear movement able to be outputted as a vibrational output (eg. a hammering or shaking output); there being a drive to cause such relative rotation and apparatus (e.g. it may be the apparatus itself) to receive the kinetic energy of at least some of the rectilinear movement and thus the vibrational output.

In an or another aspect the invention is vibrational apparatus comprising or including apparatus to receive vibration (hereafter "housing assembly" irrespective of its form or function as it can be a tool, a bit, an anvil, a surround, a drill string casing based assembly, a bit housing, a tool housing, etc), a more outward assembly able to reciprocate with respect to at least part of the housing assembly to provide vibration (by impact at the end of a stroke, or each stroke, or otherwise passing off at least some of its kinetic energy) into the housing assembly, more inward assembly within the housing assembly and internally of the more outward assembly able to be driven to rotate relative to both the more outward assembly and the housing assembly;

wherein each of the more outward assembly and the more inward assembly has both about the relative rotation axis and at least along yet outwardly of that axis, an interacting array of magnets adapted, upon the relative rotation to interact, one array with the other, to cause reciprocation.

Optionally one or more of the following applies the environment of the magnetic arrays is a fluid environment the fluid environment is ported to reduce drag "wiper" type seals seal between said fluid environment and ambient drill environment fluid the drive is enhanced to include flywheel characteristics the drive can be a slaved magnetic drive to allow input from one magnetic system to that slaved thereto, but in a different sealed environment, that slaved magnetic system to provide a mechanical rotation of one of the magnetic arrays relative to the other.

out of phase magnetic interactions to those of said magnetic arrays provide [whether magnet to magnet or magnet to ferromagnetic material] a smoothing out of the cogging effect.

In an or another aspect the invention is vibrational apparatus comprising or including apparatus to receive vibration (hereafter "housing assembly" irrespective of its form or function as it can be a drill string casing based assembly, a bit housing, a tool housing, etc), a stator assembly able to reciprocate with respect to at least part of the housing assembly to provide vibration (by impact at the end of a stroke, or each stroke, or otherwise passing off at least some of its kinetic energy) into the housing assembly, a rotor assembly within the housing assembly and internally of the stator assembly able to be driven to rotate relative to both the stator assembly and the housing assembly;

wherein each of the stator assembly and the rotor assembly has over an annular zone, both about the rotor axis and at least along yet outwardly of that rotor axis, an interacting array of magnets adapted, upon relative rotation of the rotor assembly and stator assembly, to interact, one array with the other, to cause the reciprocation.

In an or another aspect the invention is a vibrational apparatus capable of providing a vibrational output, the apparatus comprising or including first and second assemblies able to be caused by a relative rotation about a rotational axis to assume a vibration causing reciprocating relative axial movement able to be outputted (eg. into part of the apparatus or otherwise);

wherein said first and second assemblies each has a magnetic array set out from the common axis yet around the common axis and longitudinal of the common axis;

and wherein it is the interactions between the magnetic arrays consequential to the relative rotation that provides a relative drive longitudinally of the common axis.

In yet another aspect the invention is a vibrational apparatus capable of providing a vibrational output, the apparatus comprising or including first and second assemblies able to be caused [eg. preferably by a fluid feed (eg. to a PDM)] to have a relative rotation about a rotational axis ("common axis") and as a consequence to assume a vibration causing reciprocating rectilinear movement along or parallel to the common axis able to be outputted;

wherein said first and second assemblies each has magnetic arrays set out from the common axis yet around the common axis and longitudinal of the common axis;

and wherein it is the interactions between the magnetic arrays consequential to the relative rotation that provides a relative drive longitudinally of the common axis.

In another aspect the invention is a hammering assembly or downhole hammering apparatus having a stator, a rotor and at least a part housing (eg. a housing assembly as previously defined) for both the stator and rotor;

wherein the stator is reliant on or is able (i) to move reciprocally in the housing and (ii) to be caused to move axially of the reciprocation axis, at least in one axial direction, to provide a hammering or shaking affect to or on the housing [or a structure dependent therefrom];

and wherein the reciprocation of the stator relative to the housing is consequential upon relative rotation of the rotor and stator relative rotation axis, each having its array both longitudinally of the relative rotation axis and encompassing the rotational axis, and being able to interact with the other array to provide reciprocation upon the relative rotation.

In another aspect the invention is vibrational apparatus reliant on a stator in the form of a sleeve, surround or the equivalent of a rotor;

wherein the stator is able to move reciprocally and is able to be caused to move axially of the reciprocation axis, at least in one axial direction, to provide a hammering affect, a shaking affect or other vibrational outputting affect as a consequence of relative rotation of at least substantially coaxial inwardly directed magnetic array and outwardly directed magnetic array about their axes of the stator and rotor respectively.

In yet another aspect the invention is a downhole hammer or shaker assembly reliant for its hammering or shaking affect upon relative rotation between at least substantially coaxial magnetic arrays, each extending as a mutually concentric array longitudinal of but set out from the relative rotational axis, there being (i) a magnetic array of the hammer, that hammer being a stator reciprocatable within the drill string, and (ii) a magnetic array of a rotor within the stator, to provide a longitudinal drive of the hammer.

In another aspect the invention is vibrational apparatus of a kind able to output vibration as a consequence of relative axial reciprocation between a stator and a rotor, the apparatus comprising or including a stator splined to reciprocate within an at least partial casing or housing consequential upon relative rotation between a rotor and the stator on a rotational axis at least substantially parallel to the reciprocation locus; wherein (I) as the stator, at least there is (a) a surround of the rotor, (b) stator magnets carried directly or indirectly as part of the surround and arrayed both longitudinally and circumferentially about the rotor, (II) as the rotor, at least there is (i) a drive rotatable shafted assembly extending through the zone of stator magnets, the drive being able to cause relative rotation between the rotor and stator, and (ii) rotor magnets carried as part of the shafted assembly and arrayed both longitudinally and at least substantially circumferentially.

The invention in another aspect is the use of a shielded or unshielded substantially peripheral magnetic array of a rotatably mounted rotor to drive, axially of the rotational axis, a stator having a complementary surrounding magnetic array thereby to provide (with or without striking by the stator or an extension thereof) a vibrational, hammering and/or shaking output generally or to apparatus relative to which the rotor is to rotate.

In another aspect the invention is a rotor and/or a stator and/or apparatus to accommodate both the rotor and stator, all of the vibrational apparatus as herein described.

In another aspect the invention is vibrational apparatus comprising or including an outer member or assembly, an intermediate member or assembly able to reciprocate internally of and relative to the outer member or assembly and to pass kinetic energy from its shuttling movement(s) longitudinal of its stroke(s) into the outer member or assembly, and an inner member or assembly able to rotate on a rotational axis arising from its association with the outer member or assembly and under a drive, such rotational axis passing through said intermediate member or assembly;

wherein each of the intermediate and inner member(s) and/or assembly (assemblies) (eg. as a stator and rotor respectively) has substantially concentric magnetic arrays extending longitudinally with respect to the rotational axis;

and wherein relative rotation of the arrays causes the reciprocal movement of the intermediate member or assembly relative to the inner and outer member(s) and/or assembly (assemblies).

In the aforementioned aspects preferably the arrangement is such that the intermediate member or stator with a magnetic array can be reciprocated in a direction longitudinally of a substantially tubular interaction zone.

Preferably the intermediate member is a stator and acts as a hammer by striking on an impact zone preferably carried by the outer member or assembly or the housing. Could be vice versa—(stator could be caused to rotate and rotor caused to shuttle).

Preferably the impact zone is defined by a structure able to be varied in order to limit the possible stroke in at least that impact causing direction.

Preferably there is a stop plate at the other end of the stroke. Optionally one end stop plate provided to the upward stroke can have an inserted recoil mechanism (ie. between the stator and that end stop plate) substantially as herein described.

Preferably the inner member or assembly as the rotor or the assembly being the rotor carries over an annular zone longitudinally of the rotational axis of the rotor an array of permanent magnets.

Each of the two arrays can be of the same polarity but staggered in such a way as to provide a movement substantially as hereinafter described with reference to the drawings.

In some aspects mixed poles can be used. Whatever form or polarity arrangement there might be within each magnetic array and/or between the magnetic arrays, preferably the arrangement is such that there is the axial drive referred to herein (eg. by reference to the drawings) arising simply from the relative rotation.

A simple arrangement can be that for each array there is an alternating of polarity both circumferentially of and parallel to the relative rotation axis. This can provide intersecting helical loci of individual N pole magnets interposed by like intersecting helical loci of individual S pole magnets. Of course hybrid arrangements can also work as can total different arrays.

As mentioned the permanent magnets utilised can be of any of the kinds disclosed in the aforementioned patent specifications.

Preferably the rotor or inner member magnetic array is at least surrounded by a tubular or other encasement of a material that does not prevent interaction between the two magnetic arrays. An example is a metal tube such as of inconel or titanium. Other examples exist including an extensive range of non-metallic materials as well as other alloys.

Preferably the vibrational apparatus is one having at least one of two fluid systems adapted (i) a system to keep captive a contained liquid (even though it may be required to move) e.g. slosh around and (ii) a system to allow a flow through liquid (eg. PDM driving liquid and/or drilling mud).

Preferably the rotor or inner member or assembly is shafted and there is a passageway through the shaft axis whereby fluid can be passed through the rotor assembly (eg. in the case of a downhole tool from a PDM that might rotate the shaft directly or indirectly) and from there down to and out of, a bit or tool carried by a tubular casing which is the outer member or part of the housing assembly.

There are or can be two independent fluid systems of the present invention.

There is a fluid path of one fluid system provided through the centre of the rotor eg. of an externally supplied fluid (eg. drilling mud as might be used to power a PDM that flows down to the drill bit or tool to displace the cuttings while in operation, etc).

The second fluid system provides a fluid displacement path for a captive or contained liquid (eg. a light oil or aqueous composition). This contained liquid is displaced around and between the magnetic arrays by the activity of the magnetic arrays (eg. relative shuttling and rotational movement).

The captive liquid may simply lubricate between the relatively rotating magnetic arrays, or between a cover of one array and the other array, or between a cover of each array.

Provision can be provided for a displacement pathway to keep the captive liquid from locking the relative axial movements.

Persons skilled in the art will appreciate how an environment loaded with a liquid rather than gaseous content enables less challenge to any sealing that may be wanted for the mechanism. The magnetic interaction is outwardly and inwardly through a longitudinally extending annular zone protected by non-magnetic shielding. Any presence of such liquid in that zone is not significantly deleterious to the shuttling action. Provided there is sufficient porting to allow a sufficient stroke and an effective transfer of kinetic energy, any suitable flowpaths etc can be utilised. Moreover provision can be made to ensure that there is some lubrication between the outer magnetic array and the shielded magnetic array of the rotor both to reduce the pressure differential or provide any of the advantages hereinafter described.

Optionally one or more of the following applies

- the environment of the magnetic arrays is a fluid environment
- the fluid environment is ported to reduce drag
- "wiper" type seals seal between said fluid environment and ambient drill environment fluid
- the drive is enhanced to include flywheel characteristics
- the drive can be a slaved magnetic drive to allow input from one magnetic system to that slaved thereto, but in a different sealed environment, that slaved magnetic system to provide a mechanical rotation of one of the magnetic arrays relative to the other.
- out of phase magnetic interactions to those of said magnetic arrays provide [whether magnet to magnet or magnet to ferromagnetic material] a smoothing out of the cogging effect A device of the present invention can be positioned either above—or below the rotational power source.

A device of the present invention can be used (but is not limited to) in conjunction with the following down hole applications;

shifting valves
setting plugs
setting screens
sand control in screens
milling
scale removal
cementing
core sampling
drilling
fishing for stuck tools
wire line applications
vibration/oscillation to the drill string and/or tools connected to the drill string.

A device of the present invention can be such that the power source has a dual rotational output thereby enabling the vibrational device to be located above the rotational power source and some other tool (e.g. a drill bit/milling tool etc) to be located below the power source.

As used herein the terms "magnetic array" or "arrays of magnets" (or variations of those terms) include any permanent magnetic material arrayed as at least substantially discrete magnets or as a line (merged or otherwise) of magnets oblique to the rotor/stator common axis.

The materials can be selected from permanent magnets (particularly Rare Earth type magnets of high magnetic density, eg. Neodymium magnets, such as those of NdFeB, can be stable to 190° C. and Samarium Cobalt magnetic (FmCo) which can be used up to 400° C.).

Other forms of magnet can be utilised including those magnets that may be developed in the future.

Many other array dispositions of same pole, different pole or mixed pole can be used for one or other, or both, the stator and the rotor.

As used herein the term "(s)" following a noun means one or both of the singular or plural forms.

As used herein the term "and/or" means "and" or "or". In some circumstances it can mean both.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

Figure 1:
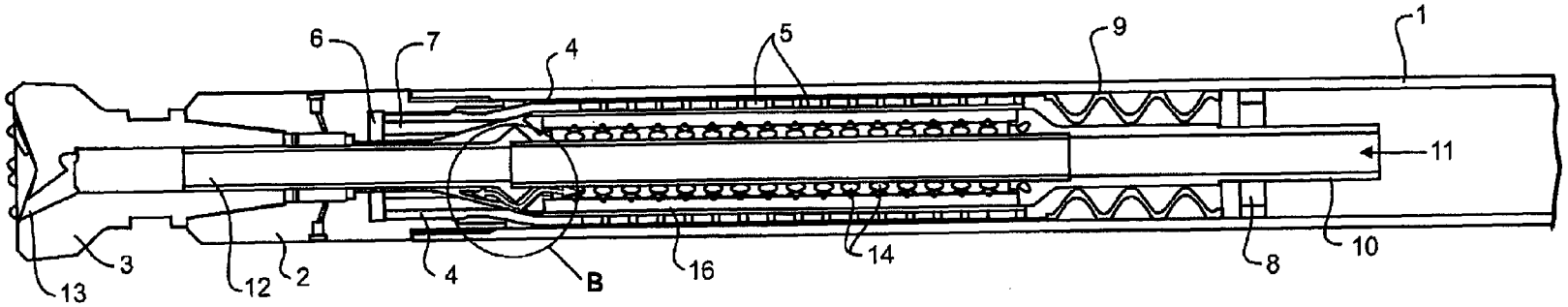
Figure 2A:
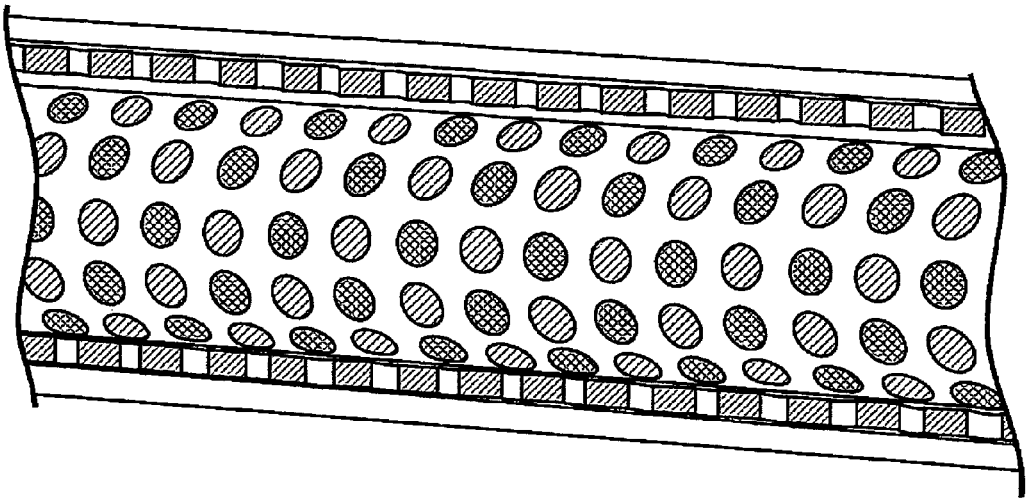
Figure 2B:
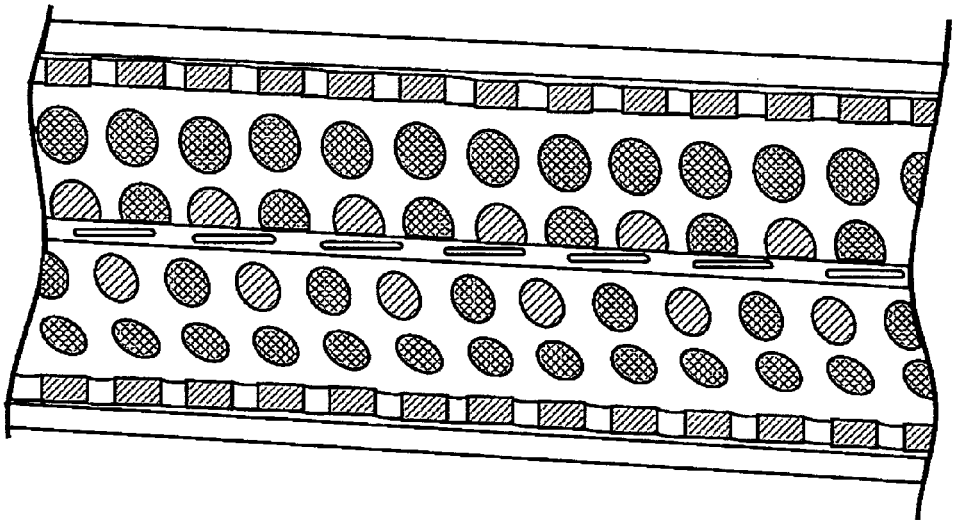
Figure 3A:
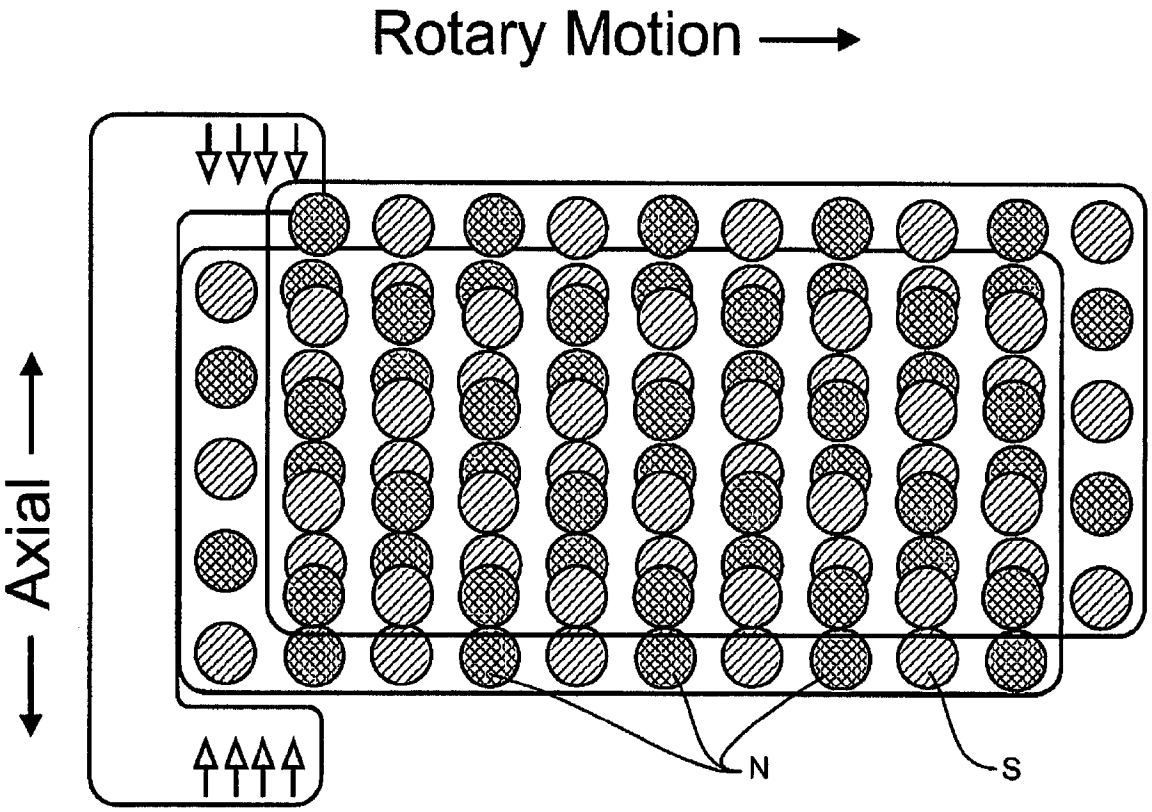
Figure 3B:
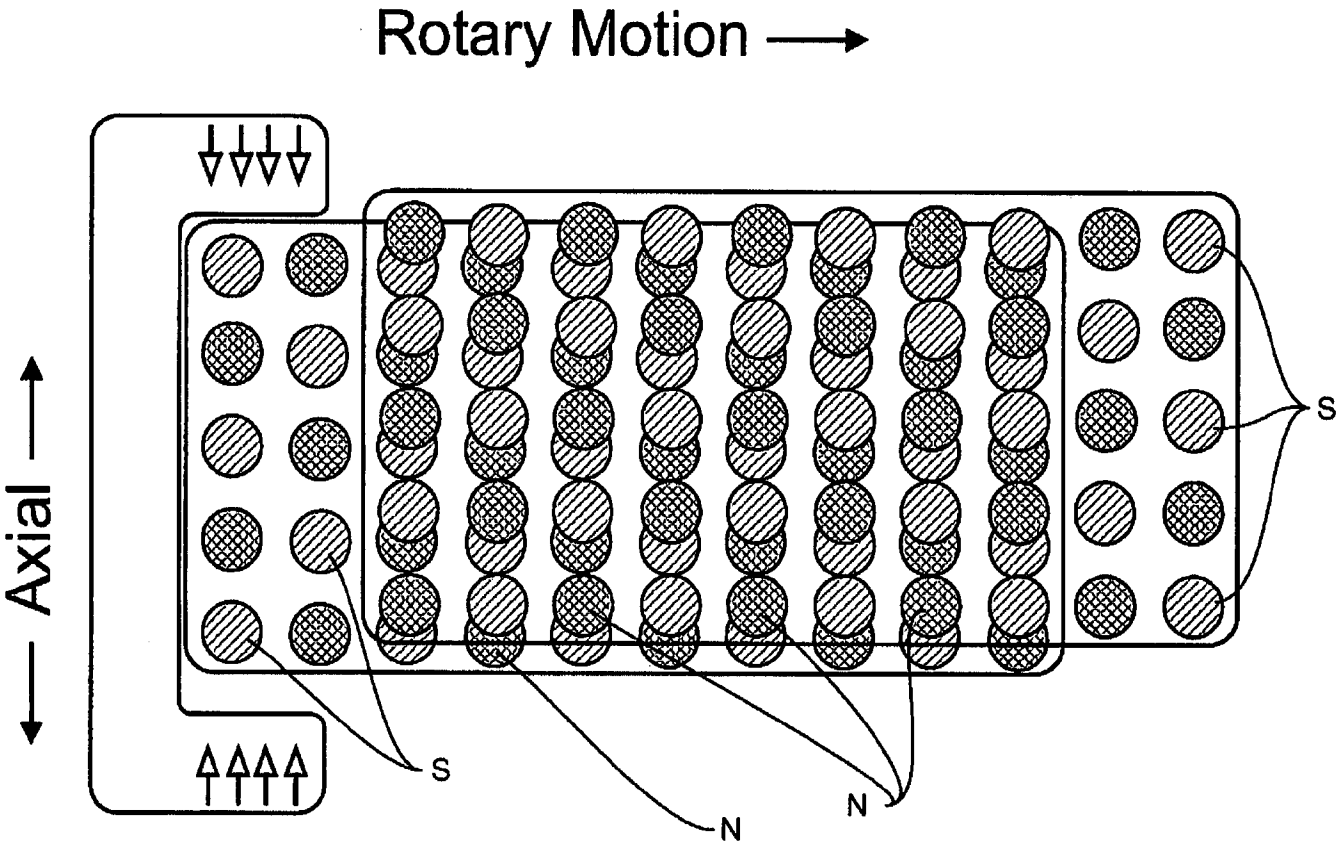
Figure 3C:
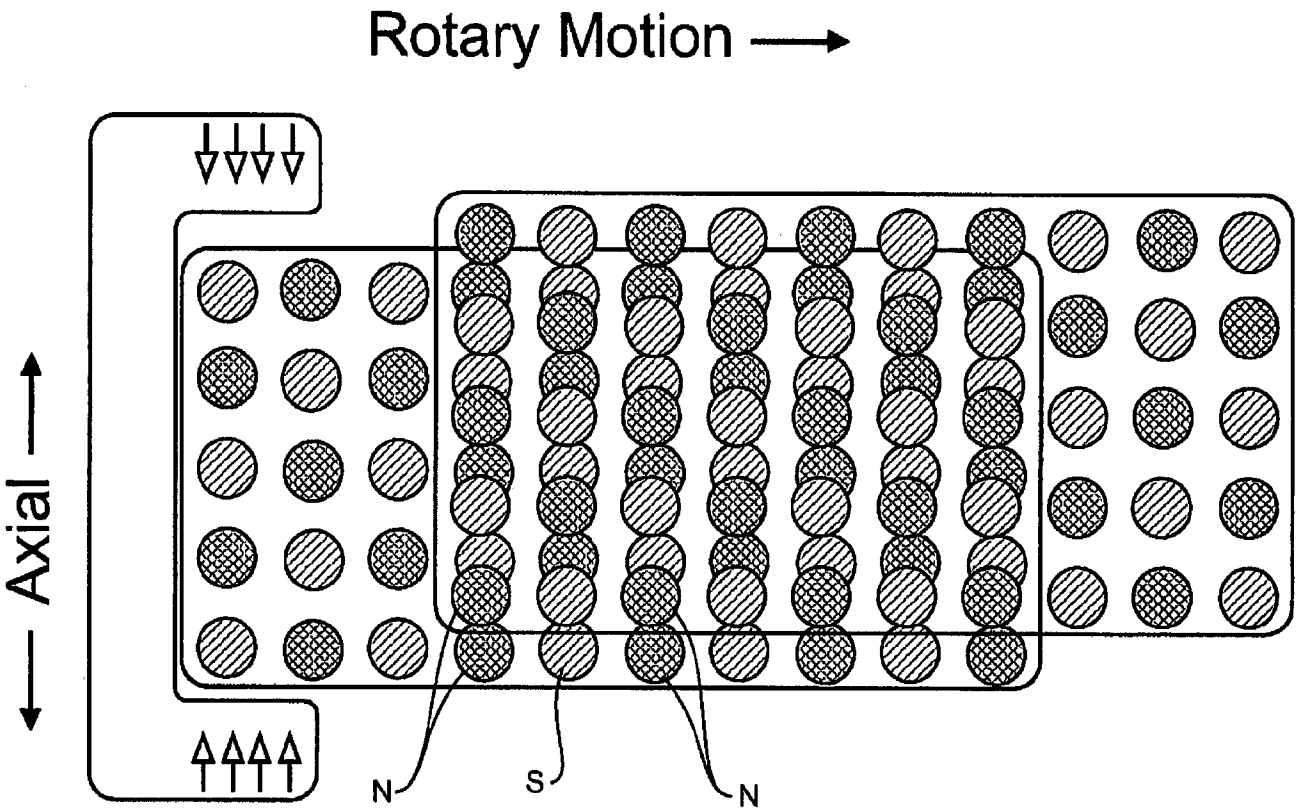
Figure 3D:
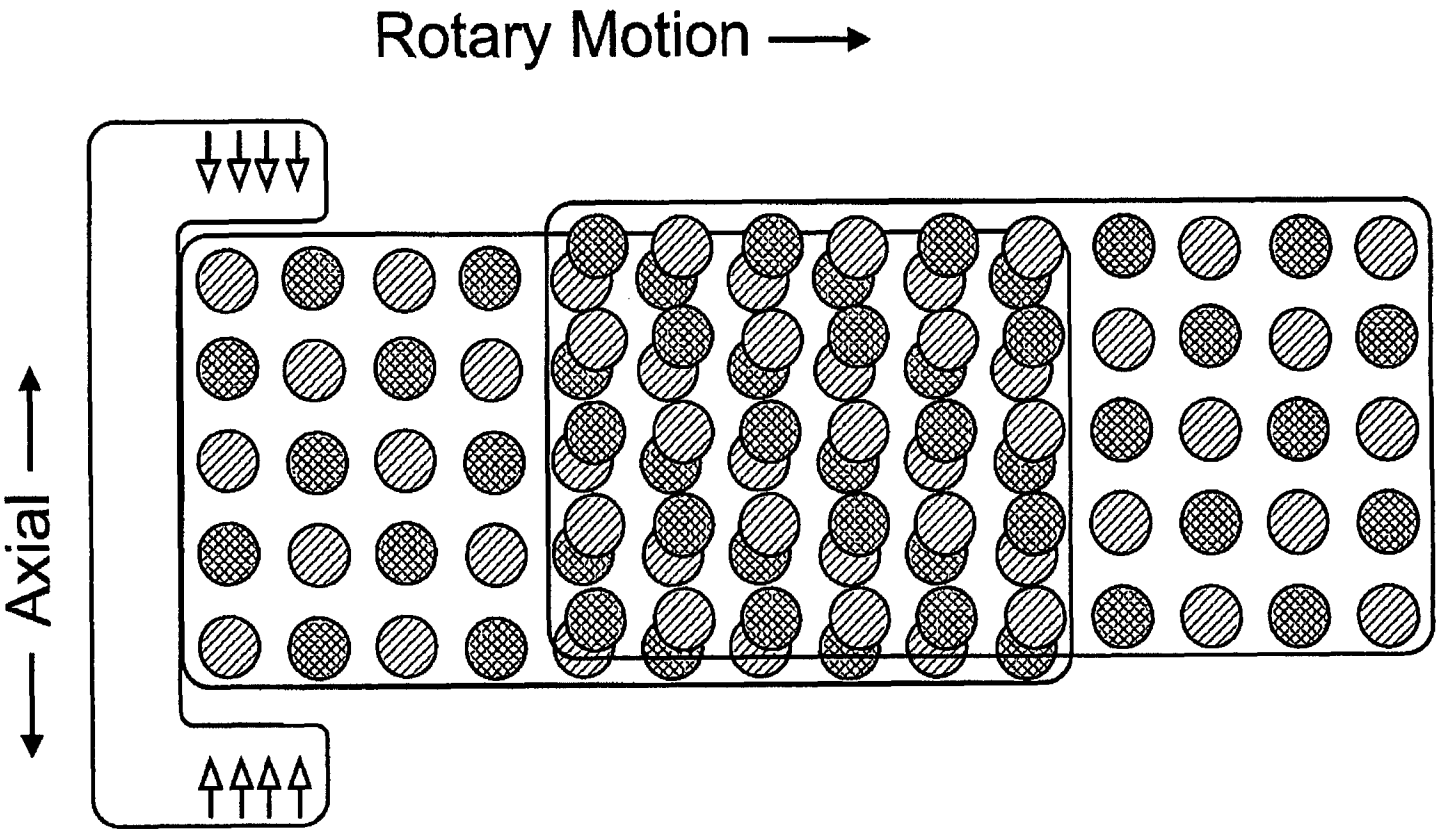
Figure 3E:
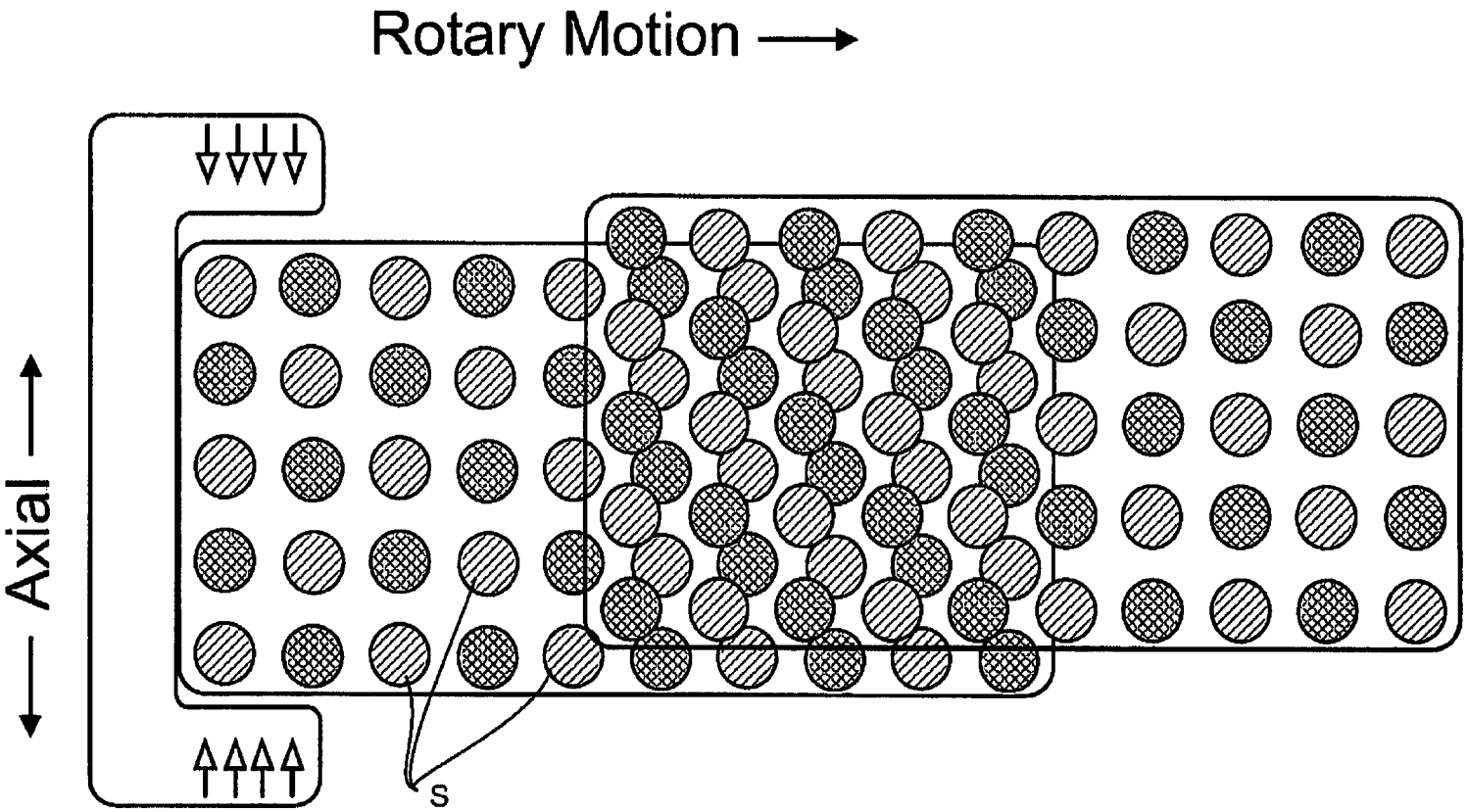
Figure 4A:
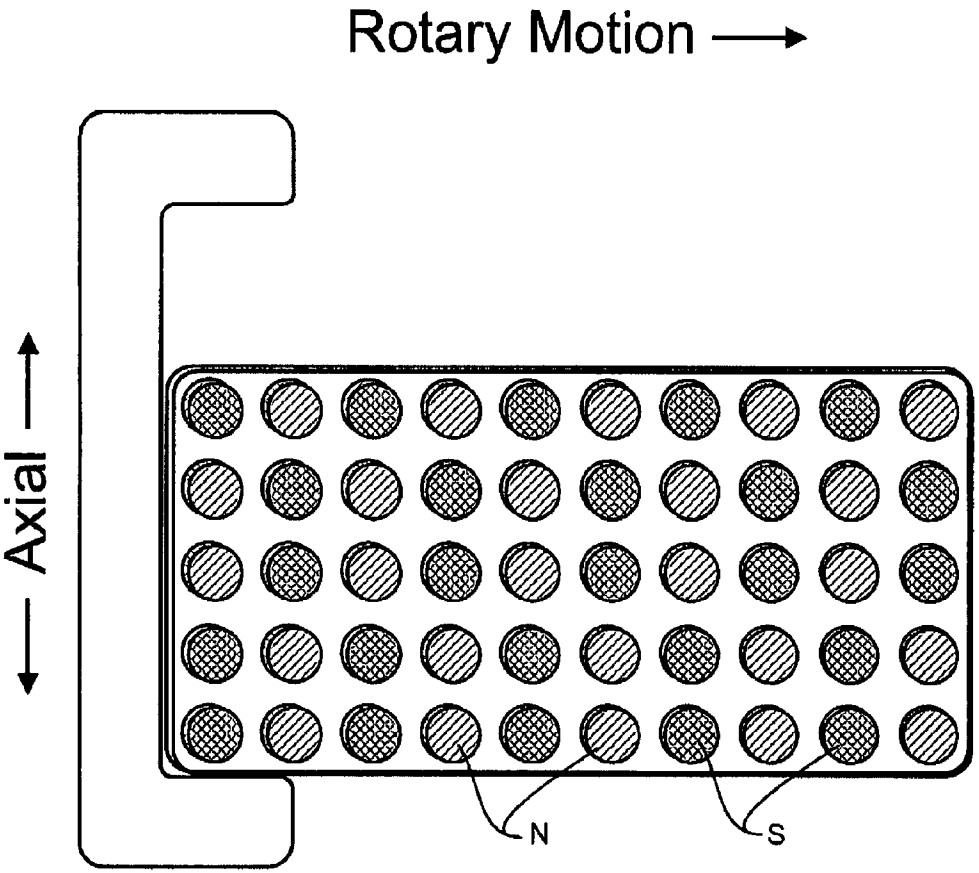
Figure 4B:
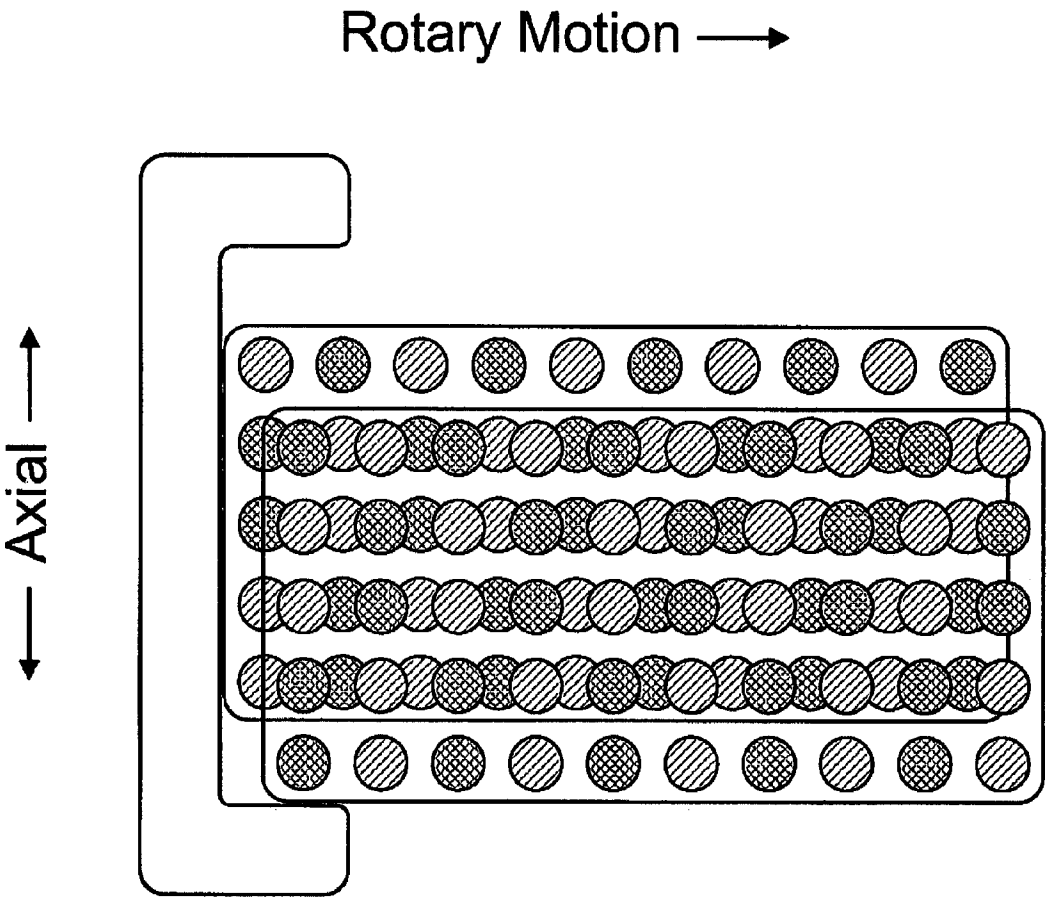
Figure 4C:
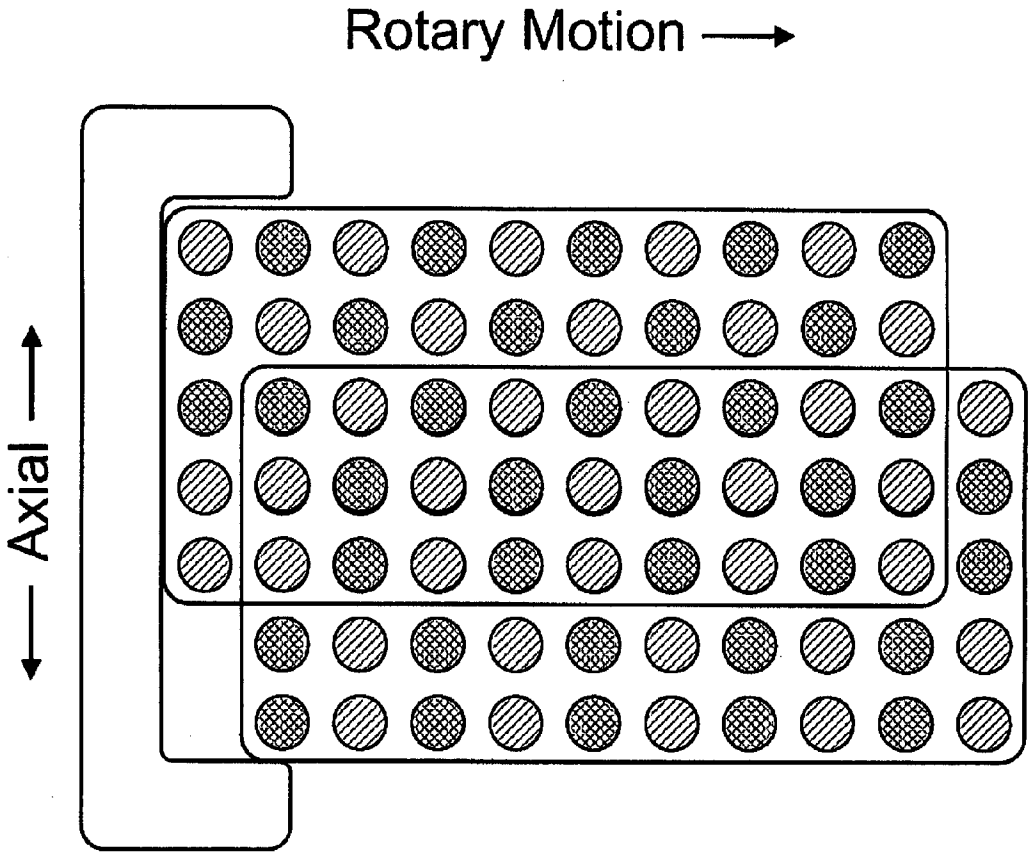
Figure 4D:
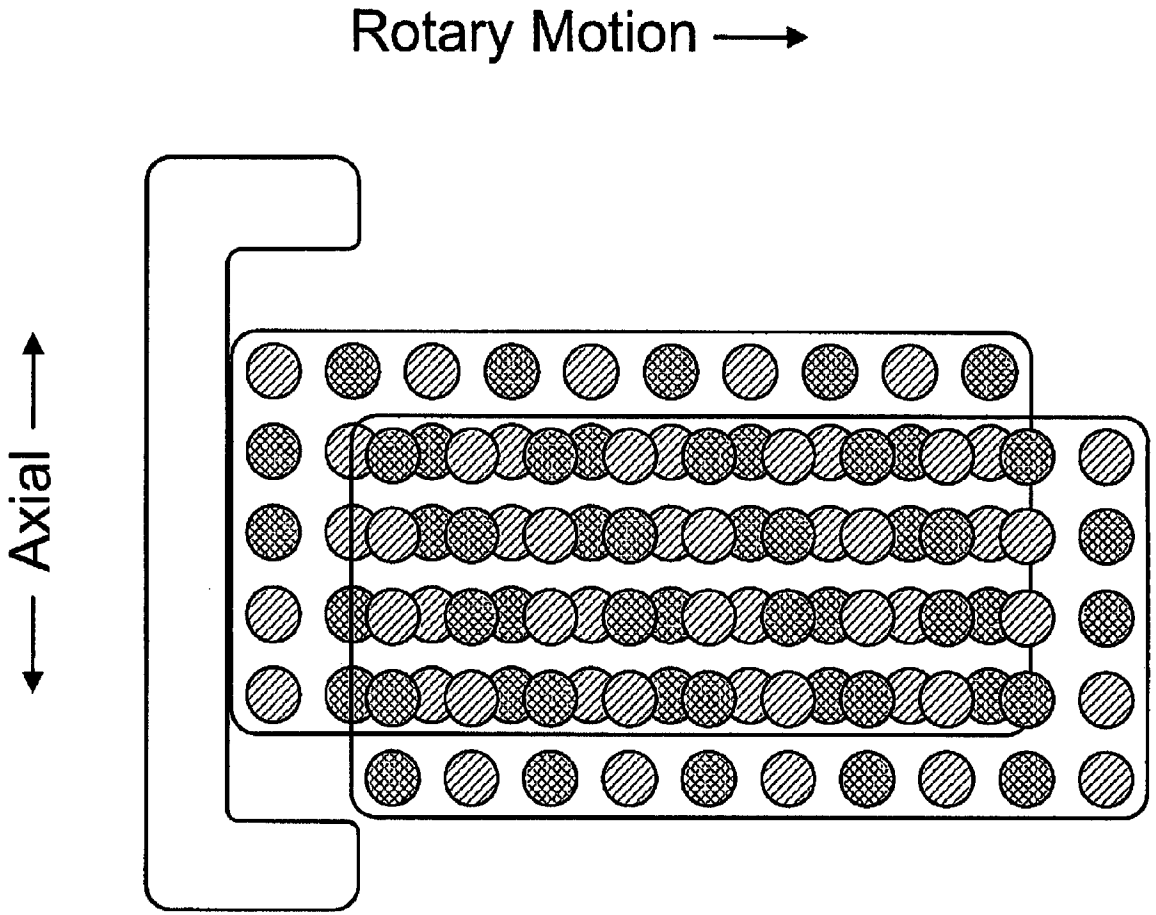
Figure 4E:
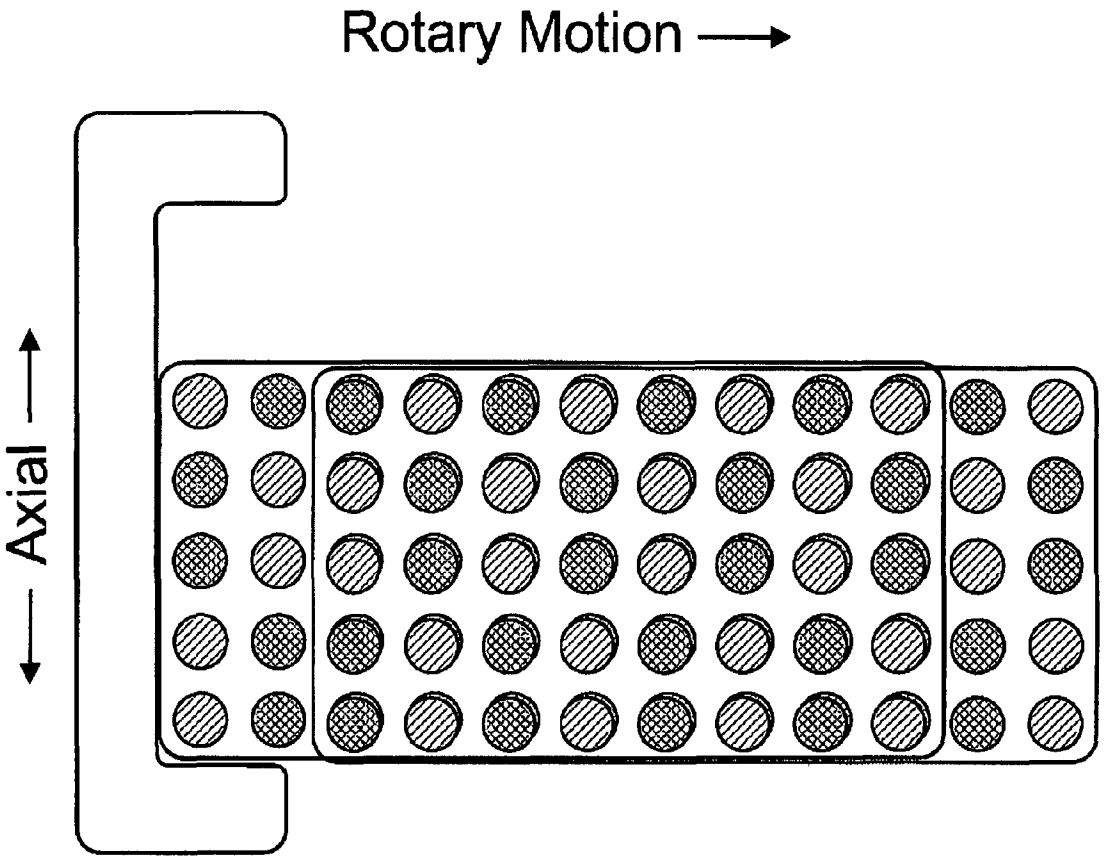
Figure 5:
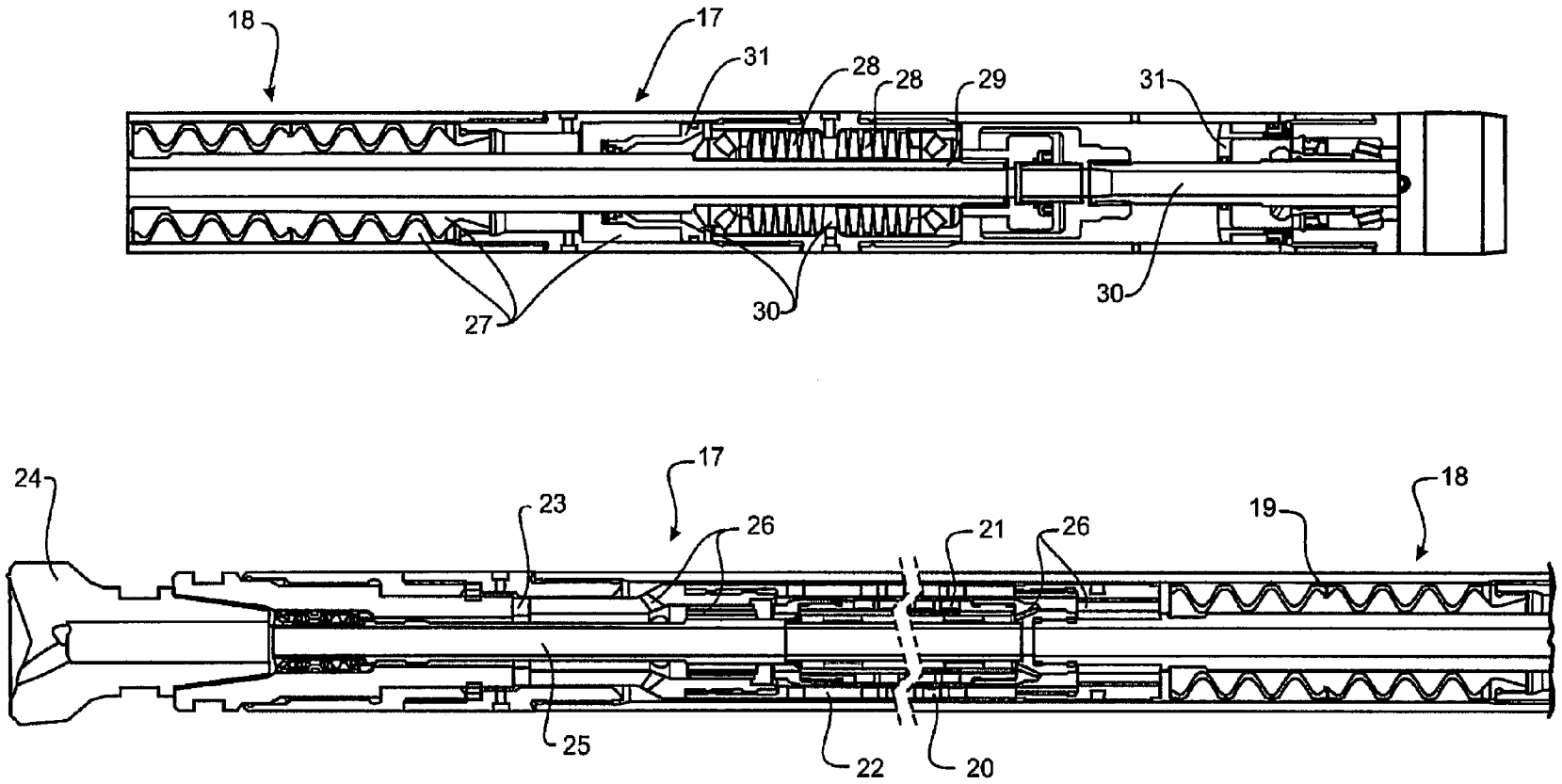

A preferred form of the present invention will now be described with reference to the accompany drawings in which FIG. 1 shows by reference to a downhole hammering apparatus, one example of use only, in section through the longitudinal common axis of relative rotation of (a) the rotor and (b) the housing assembly/tool housing splined stator, a shaft of the rotor can be caused to rotate relative to the stator and housing thereby to provide a relativity of rotation between the arrays of magnets able to interact, and as a consequence, cause the relative axial movement, FIG. 1A shows a flow path over greater detail of region 'B' of FIG. 1, FIGS. 2A to 2B respectively show, as if arrayed about and set down into a cylinder (and without shielding over the magnets) how it is optionally oblique rows of discrete magnets that can be arranged, if wanted, in optional sets on the rotor, and a sectioned half only of what is shown in FIG. 2A backgrounded by a view inside of the sectioned shuttle, showing optimal disposition of discrete magnets of the shuttle (optionally in any complementary or effective arrangement), FIGS. 3A to 3E show (as an explanation in two dimensions as opposed to three dimensions) how a carried magnetic array during rotation interacts with the other carried magnetic array thereby, when notionally flattened down to two dimensions as shown, it assumes a substantially sinusoidal movement of one array relative to the other, FIG. 4A to 4E in a manner, similar to that of FIGS. 3A to 3E, shows how the arrays can be modified in order to affect performance as herein after described, and FIG. 5 shows (as two parts) a preferred assembly embodying features of the present invention.

In FIGS. 2A to 4E a simple depiction is given for the different polarities. For instance the singly cross-hatched magnets can be considered as S poles and the doubly cross-hatched magnets as N poles, or vice versa.

A preferred form of the present invention is shown in FIGS. 1 and 5 where there is a housing component or casing of a tubular kind 1 (eg. drill string type) adapted to carry the aligned tool housing member 2 which in turn optionally can carry a tool 3. The tool shown as 3 is a bit that can be fitted in any known manner.

Carried by the outer body or housing 1 and splined relative thereto is a stator body 4. This body 4 carries stator magnets 5 of the outer array.

This shuttle as a stator (ie. not intended to rotate relative to the outer member 1) can reciprocate left and right with respect to FIG. 1 thereby to impact on end stop member 6 with the impact face 7 of the stator shuttle 4. In the other direction, preferably there is no impact on, for example, the upper end stop 8. In this respect preferably there is a recoil arrestor 9 such as disclosed in our PCT/NZ2011/000084.

It will be appreciated that the present invention does not need to utilise this recoil arrestor in order to be operational as such the impact of the shuttle will be directly onto an end stop that can be provided in place of the recoil arrestor. In further embodiments it will be appreciated that the impact shock provided by the shuttle can be either just up-hole or just downhole.

As can be seen, a PDM (not shown) can power the upper end region (directly or indirectly) of the shafted rotor 10 thereby to allow fluid to enter at 11 and to pass down via the portion 12 through the bit and out of the bit at 13.

Provision can be made for the rotor to be largely formed of a single material. The rotor includes the inner magnetic arrays shown as 14.

Preferably a tubular member of, for example, a magnetic field permeable material (eg. inconel or other) 16 is provided to ensure the integrity of the spinning magnetic array of the rotor.

As can be seen however there can be multiple ports to allow fluid to flow through between the stator and the outer body. In this respect see the flowpath shown in FIG. 1A as 17.

In the drawings consider the polarities as different according to the cross hatching of the magnets in each of the arrays. Consider a magnetic flux transparent cover of each, one to rotate with the inner assembly and one to rotate with the outer assembly. Consider a chamber (e.g. annular chamber) or a film (annular film) of a liquid (e.g. oil) between the covers and with any pooled liquid at each end region being able to be moved (sloshed) [for example via a pathway] so as not to lock up the reciprocation prior to a vibrational output.

Also consider shrouding of the outer array on its outside (e.g. with a magnetic field containment material e.g. ferrous) and likewise anywhere also to prevent magnetic flux pathways.

There is expected to be a substantial part reduction (eg. for instance in the described embodiment up to 80% reduction) required to assemble the present invention over those hammers of our earlier patent specifications with an expected two part sub assembly making for simple put together and break down. With less parts, the present invention will be cheaper to manufacture and assemble with a subsequent increase in reliability due to the decreased part numbers and sub assemblies.

Owing to the hammer section of the present invention having the ability to be flooded with a captive fluid such that equalized pressure is achieved with the downhole environment at which a preferred embodiment of the present invention will operate at, it is expected that there is potentially no limit to the pressure the hammer can operate at. In practice, it is envisaged that the limiting factor at which the hammer can operate at, will be determined by the material from which the hammer is constructed.

Options for the interacting magnetic arrays include:

- the interacting magnetic arrays are disposed concentrically (such as for example with inner and outer substantially cylindrical arrays) to interact over the radial separation, or
- the interacting magnetic arrays are disposed on the same circle (but axially spaced) to interact over the axial separation,
- the interacting magnetic arrays need not be rotated through 360 degrees to achieve a shuttling effect, a partial rotation is also envisaged to achieve the shuttling required,
- the same shuttling could be achieved by arranging the interacting magnetic arrays in various combinations or patterns.

For such an inner and outer array interaction, the frequency and amplitude of the shuttling may be altered by any one or more of the following [whether in combination or not (eg. of the hammer with its magnetic array relative to the other magnetic array)]:

- if magnetic arrays are unchanged, more input power to increase difference in relative rotation reduces amplitude of axial relative movement in favour of an increase of frequency of the movements, and/or
- if magnetic arrays increase in power, there can be an increase in amplitude of axial relative movement at the same frequency of movement, and/or
- if wanting to extend axial duration of each magnetic interaction (eg. by some grouping of same polarity magnets over axially extending zones), this can be done by increasing the amplitude of relative axial movement.

By way of example FIG. 3A to 3E show for both the inner and outer arrays regularity in set of the poles, the double cross hatching being, say, N and the single cross hatching being, say, S.

By way of example FIGS. 4A to 4E, using the same darker N/lighter S depiction, shows pairings of NN and SS on both arrays in the axial direction.

As a consequence of the magnet arrays being arranged radially within the hammer section of the present invention, the hammer is more mechanically robust and the effective diameter of the hammer is significantly reduced. This has lead to a number of advantages over our previous hammers including:

- a smaller hammer with the equivalent power output through an increase in power density per linear meter for any fixed cross section, and
- the tolerance from manufacturing has been significantly reduced.

The apparatus can be utilized as a vibratory device (e.g. not necessarily as a hammer on a tool).

The apparatus can provide vibrations for a continuous coil type downhole or other application.

Additional uses of the present invention include:—

- Freeing equipment stuck downhole,
- Drilling,
- Vibration/oscillation to the drill string or tools connected to the drill string,
- Seismic impact generation,
- Minimizing friction in downhole "extended reach" applications,
- Vibrating downhole cementing applications
- Gravel packing well screens due to the unique flow through design.

When used with or in a drill string and/or a continuous coil the vibrational device can be placed anywhere in the drill string coil—with the option of multiple units being provided.

It will be appreciated that in manufacturing the present invention, the magnets can be set into a cushioning material, such as a gel, within a hole drilled out in the shuttle and casing bodies, thus preventing collision of the magnets and to allow for subsequent replacements of magnets due to breakage.

The present invention can be tuned for frequency by either or a combination of the end spaces, and/or by altering the mud delivery from the surface pumps.

FIG. 5 shows a variation of the apparatus where a casing assembly 17 (zone 18 being in common top part of FIG. 5 to bottom part of FIG. 5).

In this arrangement there is an energy recovery spring 19 above interacting magnetic arrays 20 and 21, each interacting as described previously for the other embodiments.

Preferably the outer magnetic array is an assembly 22 keyed to the casing assembly yet able to oscillate (eg. about 16 mm) to provide an affect at the impact zone 23.

The tool 24 can be any tool preferably fed by drilling mud via the central conduit 25. Such drilling mud up the drill string can already have been used to power a pdm.

The magnetic array interactions are in a low drag liquid to better enable sealing. Fluid ports 26 can allow that liquid to slosh sufficiently so as to prevent lock-up.

Other fluids (eg. low viscosity pressure compensating liquid or fluid 27) can be used. Bearings and/or springs (used to isolate the bearings from impact or shock) shown as 29 and 28 respectively can be in a lubricating oil filled environment 30 bounded by pressure compensating pistons 31.

The apparatus briefly described above can be used in a number of different applications—and specifically the following down hole tools—but those skilled in the art will appreciate that the following examples is not an exhaustive list.

In a first application, the axially reciprocating magnetic array may impact against the tool body—thereby transmitting a high energy shock to drill bit. This type of impact has been shown to be beneficial when drilling in rock formations, where the impact is of sufficient force to cause the rock to fail.

The drill bit used in this type of application may be a fixed body "hammer" type bit or preferably a hybrid drill bit NZ patent application 588092/589004 (U.S. 61/344,883).

This tool would be preferably placed at the lower end of the drill string—although there are situations where it can be used at the start of a drill string (as a top hammer applying impact to the drill bit—via a length of drill string). Alternatively it could be used without a bit within the drill string and used as a shock tool (drilling jar) to assist with removing stuck pipe or casing. This tool may be used in conjunction with the previously mentioned fly wheel.

Another example of how this magnetic apparatus can be used is in accordance with our wire line retrievable core sampling hammer system (see PCT/NZ2011/000056) whereby the hammer can be of a magnetic nature. The drill bit used in this type of application may be a fixed body diamond core bit or preferably a hybrid drill bit (see NZ588092/589004 as previously referred to).

This tool is preferably used at the lower end of a drill string.

This tool may be used in conjunction with the previously mentioned fly wheel.

In yet another example of how this magnetic apparatus can be used is one similar to the previously mentioned hammering device for penetrating rock—however in this example there are two mechanical inputs.

Two drill rods (one within the other) are rotated (preferably) independently of each other from a surface mounted drive apparatus. The inner rod is used to rotate the rotationally driven magnetic array—causing the second axially moving magnetic array to hammer against the tool body and drill bit, the second axially oscillating magnetic array is synchronously rotated with the outer drill rod. The outer drill rod rotation also controls the force applied to the drill bit and is used to control the rotational speed of the bit, required to allow the drill bit to rotate and hammer fresh rock.

The drill bit used in this type of application may be a fixed body "hammer" type bit or preferably a hybrid drill bit (see NZ588092/589004 as previously referred to), or any type of compatible bit such as a roller cone bit.

This tool is preferably used at the lower end of a drill string.

This tool may be used in conjunction with the previously mentioned fly wheel.

N.B all of the previously mentioned examples of this device have some or all of the following attributes;

1. Preferably used with a low viscosity fluid to minimise high pressure differential sealing issues.
2. Can use any magnetic array that will induce an axial reciprocating motion, when "excited" by a rotating magnetic array—indeed any shaped magnets can be used.
3. The term magnets—preferably refers to any magnets using the so called rare earth components, but could also be super conductors.
4. They may use a compliant mechanism(s) (e.g. spring) to minimise undesirable shock and to reuse kinetic energy which may otherwise be lost.
5. All may/may not have the above described "fluid paths"—that allow the axially moving magnetic arrays to oscillate through the fluid film with minimal losses of force.
6. All may/may not use pressure compensating pistons
7. All magnets held within both the rotating group of magnets and the axially reciprocating magnetic arrays are preferably "housed" within materials of high electrical resistivity (e.g. Inconel, Monel, titanium, austenitic stainless steel, carbine fibre etc)
8. A suitable rotary input (e.g. PDM, drilling turbine—or an electrical, pneumatic, hydraulic or other) is provided to rotate the rotationally activated magnetic array.
9. All preferably have at least one of the magnetic arrays synchronously rotated with the drill string.
10. All preferably require a splined connection (or similar) that synchronously connects the axially reciprocating magnetic array to the outer body (and by extension to the drill string) and allows the reciprocating action to occur under the influence from the rotational magnetic array.
11. All of the above devices may be used with a mechanical or magnetic fly wheel.

The invention claimed is:

1. A vibrational apparatus, whether uphole or downhole, to be operable as part of a drill string, which apparatus comprises or includes an elongate casing;

an outer elongate assembly substantially coaxially disposed within the casing and constrained against rotation, but not reciprocal longitudinal rectilinear movement, with respect to the casing, the outer elongate assembly having an array of magnets coaxially of and longitudinally of the outer elongate assembly, each magnet of the array having a single pole, whether of mixed or unmixed poles in the array, facing inwardly;

an inner elongate assembly at least substantially coaxially disposed within the outer elongate assembly, the inner elongate assembly being adapted to duct a fluid longitudinally of at least part of the vibrational apparatus and providing an array of magnets coaxially of, and longitudinally of, the inner elongate assembly, and at least substantially within, but spaced from, yet coaxially, of the array of the outer elongate assembly, the magnets of the inner elongate assembly each having a single pole, whether of mixed or unmixed poles in the array, facing outwardly;

wherein the inner or outer elongate assembly is rotatable under the action of a drive to rotate relative to the other elongate assembly thereby to cause a relative reciprocal rectilinear movement between the inner and outer elongate assemblies as a result of multiple magnetic interactions across the elongate and longitudinally extending annular spacing between the magnetic arrays;

and wherein relative rotation of the inner and outer elongate assemblies and the consequential reciprocal rectilinear movement provides a vibrational output from the vibrational apparatus;

and wherein the drive derives an input from said fluid to directly or indirectly cause the relative rotation of the inner and outer elongate assemblies yet that fluid is excluded from the said elongate annular spacing, notwithstanding such spacing may contain another fluid.

2. The vibrational apparatus of claim 1 when operable downhole as part of the drill string.

3. The vibrational apparatus claim 1 wherein each magnet of one pole type presenting as a single pole to proximally interact across the annular space is on a helical locus of such pole types of magnets in its array.

4. The vibrational apparatus of claim 1 wherein the reciprocal rectilinear movement is with impacts.

5. The vibrational apparatus as claimed in claim 1 wherein said fluid is able to pass through the vibrational apparatus.

6. The vibrational apparatus as claimed in claim 5 wherein a fluid feed to a PDM, turbine or other suitable drive rotates the inner elongate assembly, the outer elongate assembly being splined to, or otherwise non-rotatable relative to, an outer case of a drill string of which vibrational apparatus is part as such as to cause the relative rotation.

7. The vibrational apparatus as claimed in claim 1 wherein said inner and outer elongate assemblies are enclosed in a common chamber.

8. The vibrational apparatus as claimed in claim 7 wherein said common chamber includes a liquid.

9. The vibrational apparatus of claim 1 having a flywheel including rotational drive input to one of the inner and outer elongate assemblies.

10. The vibrational apparatus of claim 9 wherein the flywheel is a mechanical or magnetic flywheel, a magnetic flywheel in the sense that it smoothes the cogging effect that otherwise might occur.

11. The vibrational apparatus of claim 10 wherein the flywheel is between a drive and one of the inner and outer elongate assemblies.

12. The vibrational apparatus of claim 11 where the drive is a PDM/turbine/mechanical or electric drive.

13. The vibrational apparatus of claim 1 wherein a liquid interposed between the assemblies assists, or will assist, in resisting ambient downhole pressure.

14. The vibrational apparatus of claim 1 which is a hammering apparatus.

15. The vibrational apparatus of claim 1 which is used in conjunction with any one or more of the following downhole applications shifting valves
setting plugs
setting screens
sand control in screens
milling
scale removal
cementing
core sampling
drilling
fishing for stuck tools
wire line applications
vibration/oscillation to the drill string and/or its attached drill string.

* * * * *